US006341492B1

(12) United States Patent
Carey

(10) Patent No.: US 6,341,492 B1
(45) Date of Patent: Jan. 29, 2002

(54) OIL RETURN FROM CHILLER EVAPORATOR

(75) Inventor: Michael D. Carey, Holmen, WI (US)

(73) Assignee: American Standard International Inc., New York, NY (US)

( * ) Notice: Subject to any disclaimer, the term of this patent is extended or adjusted under 35 U.S.C. 154(b) by 0 days.

(21) Appl. No.: 09/578,226

(22) Filed: May 24, 2000

(51) Int. Cl.[7] ..... F25B 43/02

(52) U.S. Cl. ..... 62/84; 193/471; 193/515

(58) Field of Search ..... 62/84, 193, 471, 62/472, 505, 507, 515, 500; 165/117

(56) References Cited

U.S. PATENT DOCUMENTS

| | | | | |
|---|---|---|---|---|
| 3,563,051 A | | 2/1971 | Baumgartner | |
| 4,534,182 A | | 8/1985 | Toub et al. | |
| 4,625,523 A | | 12/1986 | Toub et al. | |
| 4,715,196 A | | 12/1987 | Sugiura | |
| 4,918,944 A | | 4/1990 | Takahashi et al. | |
| 5,165,248 A | | 11/1992 | Sishtla | |
| 5,606,872 A | | 3/1997 | Terasaki | |
| 5,761,914 A | | 6/1998 | Carey et al. | |
| 5,875,640 A | | 3/1999 | Hill | |
| 5,890,374 A | | 4/1999 | Lee | |
| 6,116,046 A | * | 9/2000 | Leaver et al. | 62/473 |
| 6,170,286 B1 | * | 1/2001 | Keuper | 62/471 |

* cited by examiner

*Primary Examiner*—Henry Bennett
*Assistant Examiner*—Melvin Jones
(74) *Attorney, Agent, or Firm*—William J. Beres; William O'Driscoll

(57) ABSTRACT

Oil return from the evaporator to the compressor of refrigeration chiller is accomplished by routing the suction piping that communicates between the chiller's evaporator and compressor to a location physically below the lubricant-rich pool at the bottom of the evaporator shell and by connecting the lubricant-rich pool to the compressor suction piping at a location where the suction piping is disposed physically below the pool.

17 Claims, 4 Drawing Sheets

OIL RETURN FROM CHILLER EVAPORATOR

BACKGROUND OF THE INVENTION

The present invention relates to refrigeration chillers. More particularly, the present invention relates to air-cooled refrigeration chillers and, in particular, chiller the evaporators of which are located remote from the remainder of the chiller components.

Refrigeration chillers operate to cool a liquid, such as water, which is most often used to comfort condition a building or in an industrial process. Generally speaking, refrigeration chillers fall into the category of "air-cooled" or "water-cooled". The terms air-cooled and water-cooled refer to the medium to which hot refrigerant gas in the chiller's condenser rejects its heat in the course of chiller operation.

In the case of an air-cooled chiller, the chiller is typically located outdoors to enable the hot refrigerant flowing through the system condenser to reject heat to the atmosphere. Most air-cooled chillers are packaged such that all components of the chiller are located outdoors including the system's compressor, condenser and evaporator.

Historically, evaporators employed in air-cooled chillers, have more often than not been of the shell and tube, direct expansion (DX) type. Relatively cold refrigerant, primarily in the liquid form, is directed into the interior of the tubes that form a DX evaporator's tube bundle while the liquid medium to be cooled, most typically water, contacts the exterior of such tubes. As refrigerant travels the length of the tube bundle one or more times within a DX evaporator, it absorbs heat from the surrounding medium, and, as a result, is heated, vaporizes and is drawn therefrom by the system compressor.

As is the case in most chillers, a relatively small amount of the lubricant used by the system compressor, such as for bearing lubrication, cooling or sealing purposes, becomes entrained in the compressed refrigerant gas that is discharged from the compressor. The portion of such lubricant that is unable to be separated from the flow stream of gas discharged the compressor remains entrained in the gas stream and makes its way therewith to the system condenser. Such lubricant mixes with the liquid refrigerant that is created by the heat exchange process that occurs in the condenser, and then flows with the condensed refrigerant, through the system's expansion device and into the system evaporator. In the case of a DX evaporator, because the flow of refrigerant through the evaporator is interior of the tubes in the evaporator's tube bundle, the lubricant that makes its way into those tubes is capable of being drawn thereoutof and returned to the system compressor by the expedient of maintaining a predetermined velocity in the refrigerant gas flow stream that is drawn out of the evaporator tubes by the compressor.

In some air-cooled chiller installations, the physical location of the installation, the particular application in which it is used and/or the varying nature of ambient weather conditions in the locale in which the chiller is used may require or suggest that the chiller evaporator be located indoors or in a protective enclosure, remote from the remainder of the chiller. The purpose of such remote location is typically to ensure that the evaporator does not freeze. Even when DX evaporators are located remote from the remainder of an air-cooled chiller system, refrigerant velocity is capable of being maintained at a sufficient level in the suction pipe leading from the evaporator back to the system compressor to ensure that lubricant that has made its way to the evaporator is returned to the compressor.

Recently, more efficient and sophisticated evaporators have been designed and have come to be employed in chillers, including those of the falling film type. Falling film evaporators and hybrids thereof do not operate on the direct expansion principle and, instead, are of a type in which the medium to be cooled flows internal of the tubes of the evaporator's tube bundle while the system refrigerant flows exterior thereof. Liquid refrigerant is distributed, in a falling film evaporator, across the top of the evaporator's tube bundle in low-energy form and trickles downward therethrough, for the most part vaporizing in the process.

Such heat exchangers are more efficient, with respect to heat transfer, and enable the chiller to function with a reduced refrigerant charge. However, because the refrigerant in such evaporators and any lubricant flowing therewith is disposed exterior of and falls downwardly through the tubes that comprise the evaporator's tube bundle and because the suction gas drawn out of such an evaporator by the system compressor is typically drawn out of the evaporator shell above the refrigerant distributor, suction gas, as it flows out of the interior of a falling film evaporator, is generally incapable of drawing lubricant out of the evaporator for return to the system compressor. Instead, the lubricant collects at the bottom of the evaporator shell, together with any liquid refrigerant that happens not to be vaporized in its downward travel through the tube bundle.

This circumstance makes the return of lubricant from a falling film evaporator problematic, whether or not the evaporator is located remote from the compressor, and/or may require the use of oil return systems that are complicated and/or expensive to manufacture and/or control. See for instance U.S. Pat. No. 5,761,914, assigned to the assignee of the present invention and incorporated herein, in that regard. The difficulty and expense in returning lubricant to the system compressor from a falling film evaporator is, however, clearly exacerbated when the evaporator is located remote from the remainder of the chiller system.

The need therefore exists for a relatively simple, inexpensive and reliable arrangement by which to ensure the return of lubricant from a falling film evaporator to the system compressor in a refrigeration chiller particularly where such evaporator is located remote from the other components of the chiller system.

SUMMARY OF THE INVENTION

It is an object of the present invention to provide for the return of lubricant to the compressor in a refrigeration chiller that makes its way from the compressor to the system evaporator.

More particularly, it is an object of the present invention to return lubricant that makes its way from the compressor of an air-cooled refrigeration chiller to the chiller's evaporator in the circumstance that the evaporator is located remote from the compressor and, as installed, may be at a height which is physically above or below the compressor.

It is a further object of the present invention to provide for the return of lubricant, in an air-cooled chiller system which employs a remote evaporator of the type in which refrigerant flow is exterior of the tubes that comprise the evaporator's tube bundle, from the evaporator back to the chiller's compressor in a manner which is relatively simple, inexpensive, reliable and need not be proactively controlled.

It is a still further object of the present invention to accomplish lubricant return in an air-cooled refrigeration chiller that employs a remote evaporator of the falling film type by enabling the remote evaporator to function, for purposes of lubricant return, generally in the same manner as a DX evaporator.

These and other objects of the present invention, which will be appreciated when the following Description of the Preferred Embodiment and attached Drawing Figures are considered, are accomplished by routing the suction pipe that communicates between the evaporator and the compressor in a chiller system from the upper portion of the evaporator shell, where gas is drawn out of the evaporator, to a location physically below the lubricant-rich liquid pool found at the bottom of the evaporator shell. A lubricant line is disposed so as to be in flow communication with both the lubricant-rich liquid pool at the bottom of the evaporator shell and with the suction pipe, at a location where the suction pipe runs physically below the lubricant-rich pool. Because the lubricant line connects into the liquid pool at the bottom of the evaporator shell and into the compressor suction pipe at a location below the liquid pool, both gravity and head cause the lubricant-rich mixture to flow out of the pool, through the lubricant line and into the suction pipe. Additionally, but not mandatory, by the expedient of appropriately sizing the suction line, mixture flow can be enhanced by the purposeful creation of a pressure differential between the location at which lubricant enters the suction pipe and the interior of the evaporator. The delivery of the lubricant-rich liquid into the suction pipe causes such liquid to become entrained in the refrigerant gas flowing therethrough to the system compressor and oil return is, in turn, accomplished much as if the evaporator employed in the system were a DX evaporator as opposed to one in which refrigerant flow is exterior of the tubes in the evaporator's tube bundle.

DESCRIPTION OF THE DRAWING FIGURES

DESCRIPTION OF THE PREFERRED EMBODIMENT

Figure 1:
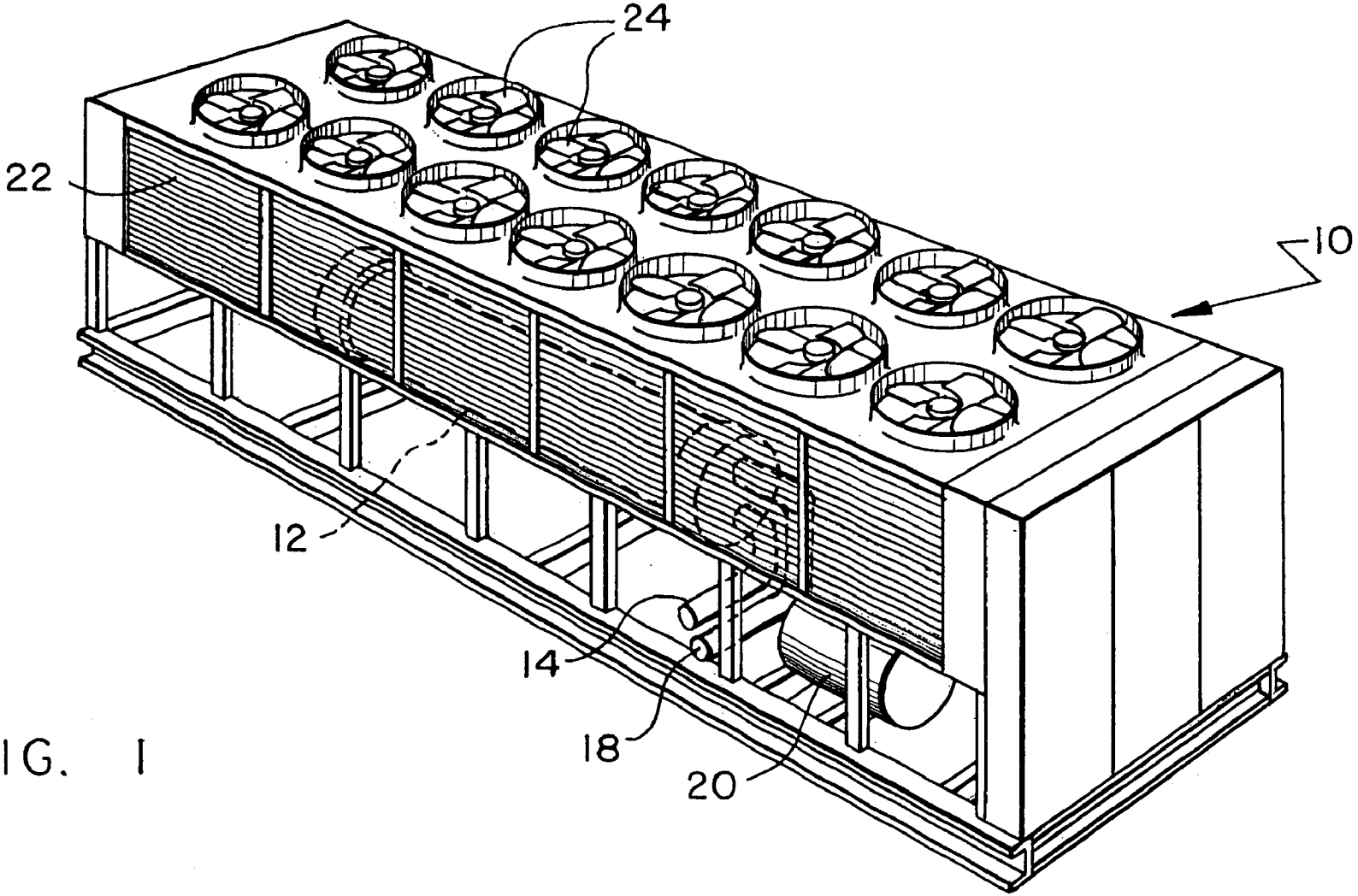
FIG. 1 is a perspective view of a packaged air-cooled chiller.
Figure 3:
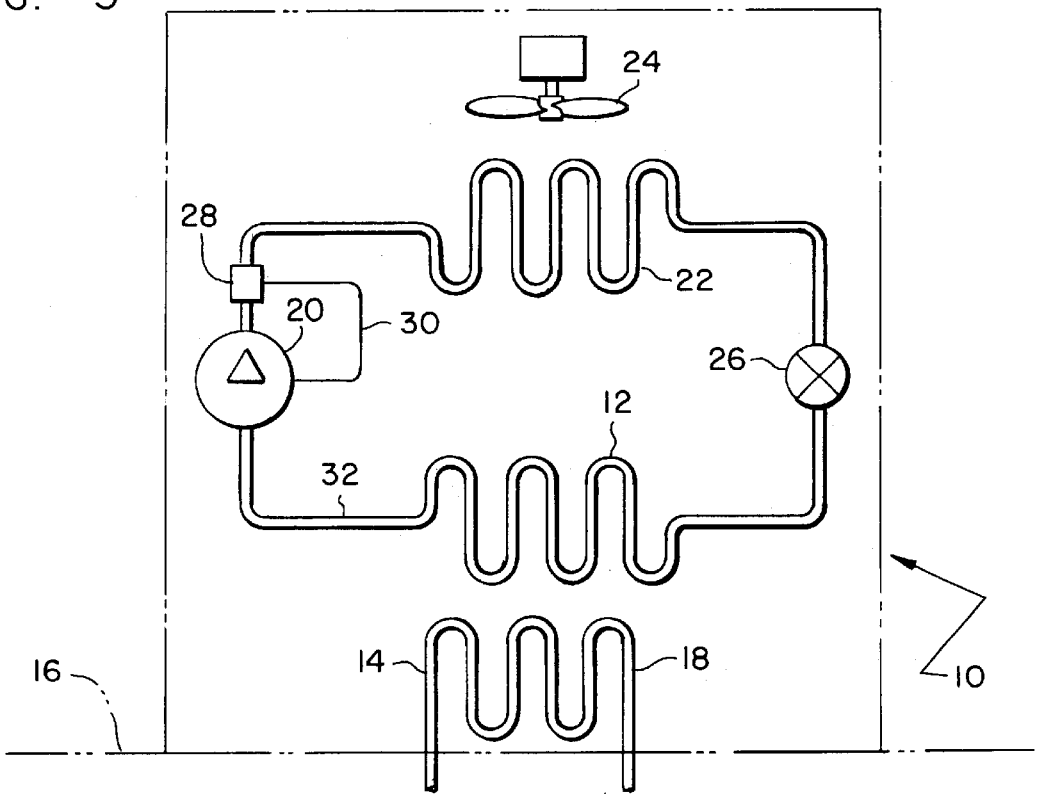
FIG. 3 is a schematic illustration of an air-cooled liquid chiller in which the system evaporator is packaged with the remainder of the chiller system, as is the case with respect to the air-cooled chiller of FIGS. 1 and 2.
Figure 2:
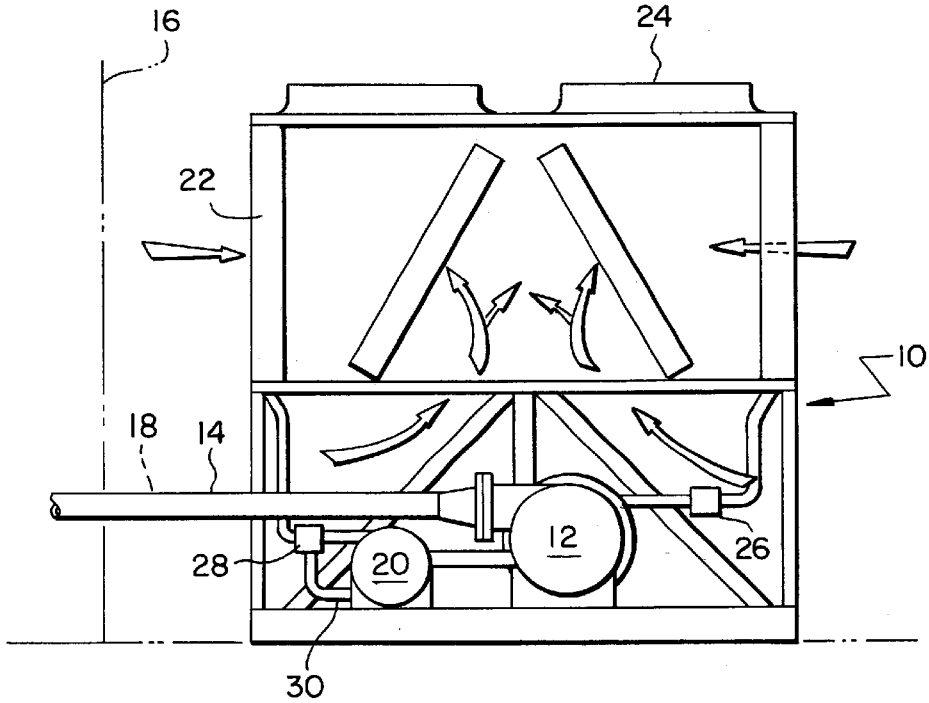
FIG. 2 is an end view of the packaged air-cooled refrigeration chiller, of the type illustrated in FIG. 1.

Referring initially to FIGS. 1, 2 and 3, a conventional packaged air-cooled water chiller 10, in which the system evaporator 12 is co-located with the remainder of the chiller components, is illustrated. A liquid, such as water, is transported in such systems to evaporator 12 through piping 14. The liquid delivered to evaporator 12 through piping 14 typically carries heat which has been rejected to it from a heat load interior of building 16 or, in the case of a manufacturing or process application, from a heat load associated with the process. The water flows into evaporator 12 where the heat it carries is rejected to the relatively cooler chiller system refrigerant that likewise flows therethrough. The water is chilled in the process and is returned, through piping 18, to the location of the heat load to further cool it.

With respect to the remainder of chiller 10, it includes a compressor 20, a condenser 22, one or more fans 24 and an expansion device 26. Compressor 20, condenser 22, expansion device 26 and evaporator 12 are connected for serial flow to form a refrigeration circuit. In operation, compressor 20 compresses the relatively warm, low pressure gas that it draws from evaporator 12 and discharges it as a higher pressure, higher temperature gas to condenser 22. Fans 24 blow ambient air across condenser 22, cooling the gaseous refrigerant flowing therethrough in the process and causing the gaseous refrigerant to condense to liquid form, still at high pressure but at a lower temperature.

Liquid refrigerant flows from condenser 22 to expansion device 26 where, by its passage through the expansion device, the refrigerant undergoes a pressure drop which causes some of the liquid refrigerant to flash to gas. This change in state of a portion of the refrigerant to gas causes the refrigerant to be further cooled. The refrigerant mixture, still primarily consisting of refrigerant in liquid form, next flows from expansion device 26 to evaporator 12 where it undergoes heat exchange in the manner noted above.

As is the case in virtually all chiller systems, some amount of the lubricant used within compressor 20 of chiller 10 will become entrained in the flow stream of refrigerant gas that is discharged from the compressor. A discrete oil separator component 28 will often be disposed in the line connecting compressor 20 to condenser 22 the purpose of which is to remove entrained lubricant from the stream of refrigerant gas discharged from the compressor. The lubricant that oil separator 28 is successful in removing from the compressor discharge flow stream is returned to compressor 20 via oil line 30.

Irrespective of how efficient it may be, a relatively small portion of the lubricant carried out of compressor 20 in the refrigerant gas stream will make its way through and past oil separator 28. Such lubricant travels to and through condenser 22 and expansion device 26 and comes to reside in evaporator 12. As has been mentioned, where evaporator 12 is a DX evaporator, the velocity of refrigerant flowing through the evaporator can be maintained sufficiently high to draw such lubricant through and out of evaporator 12 and back to the system compressor, even if evaporator 12 is physically remote from the remainder of the chiller system.

However, when evaporator 12 is of the falling film type, as is the case in the chiller of the preferred embodiment, the return of oil therefrom to the system compressor is more problematic for the reason that oil flowing into a falling film evaporator falls to the bottom of the shell thereof while refrigerant gas drawn out of the evaporator by compressor 20 is through suction pipe 32 which connects to the top of the evaporator shell, generally above the refrigerant distributor therein. As such, refrigerant gas flow out of the evaporator shell cannot be relied upon, of itself, to draw lubricant directly from the evaporator as would the case be in a DX evaporator.

Figure 4:
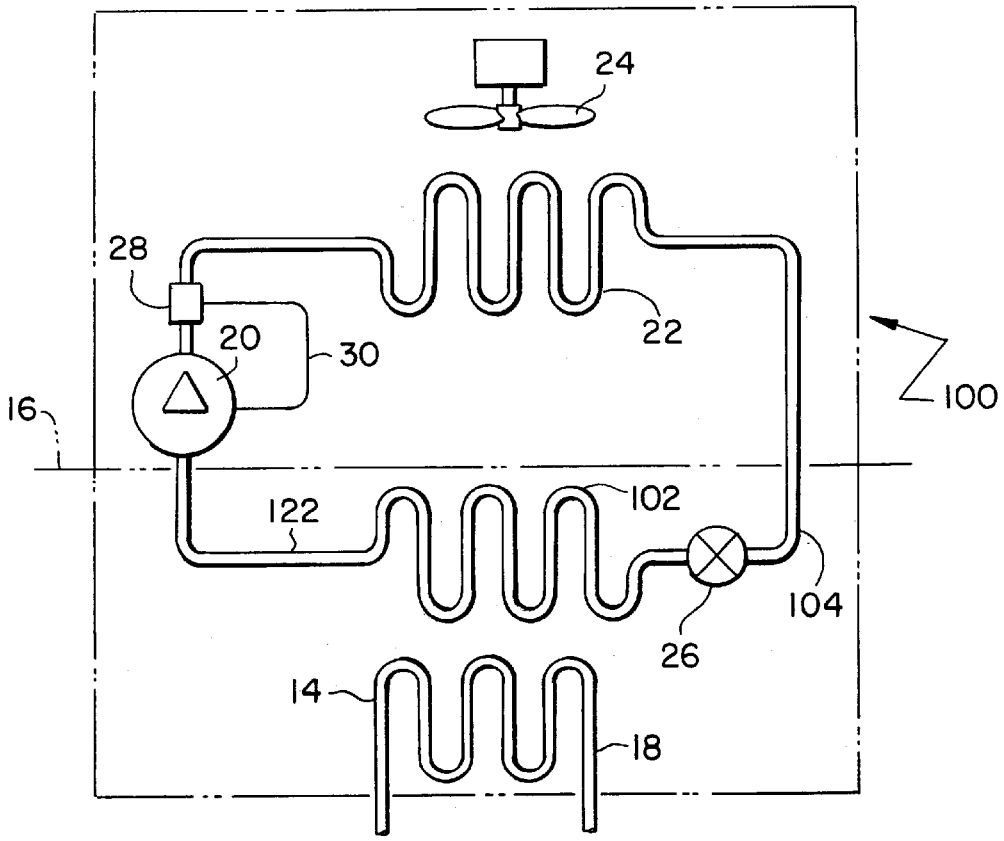
FIG. 4 is a schematic diagram of an air-cooled refrigeration chiller in which the chiller's evaporator is located remote from the remainder of the chiller system.
Figure 5:
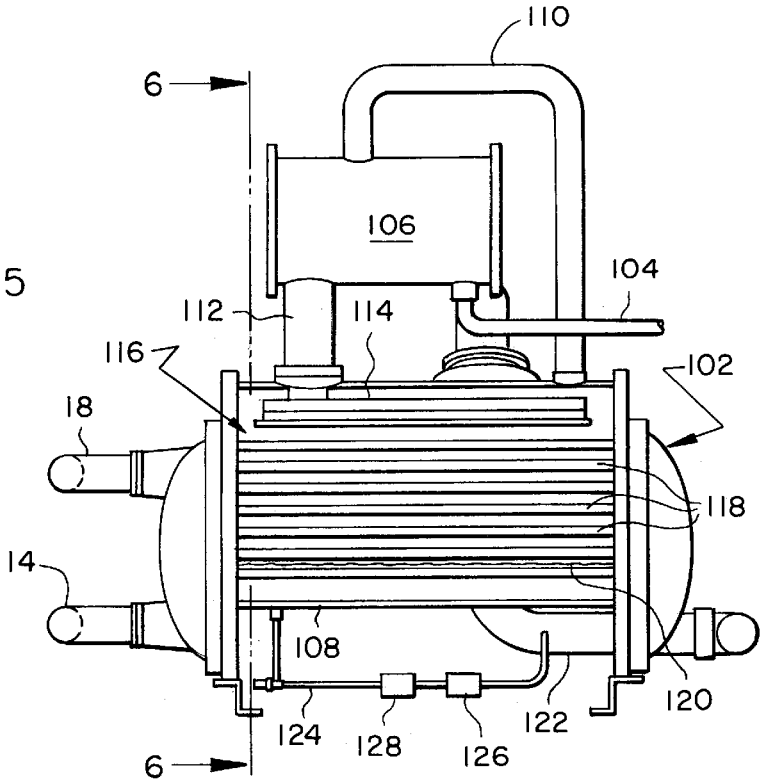
FIG. 5 is a side view of the remote evaporator employed in the chiller system of the present invention.
Figure 6:
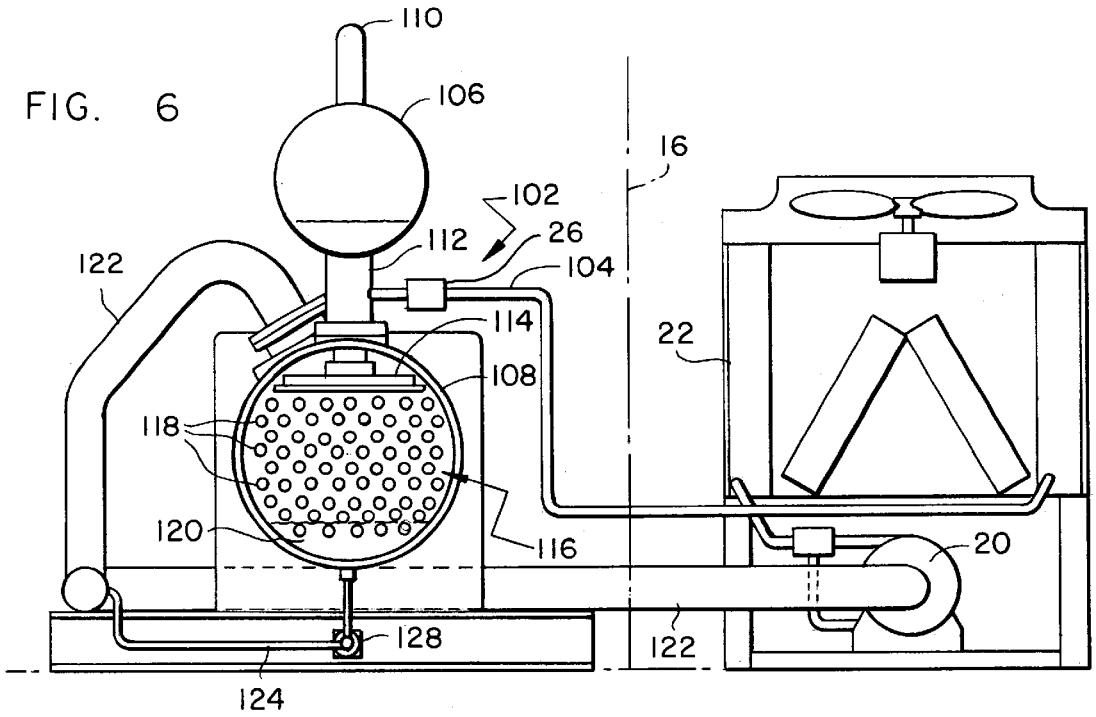
FIG. 6 is a cross-sectional view taken along line 6—6 of FIG. 5.

Referring additionally now to FIGS. 4, 5 and 6, air-cooled chiller 100 is identical to air-cooled chiller 10 of FIGS. 1, 2 and 3 in essentially all respects with the exception of the fact that the evaporator 102, associated with chiller 100, is located remote therefrom within building 16 as, typically, will be expansion device 26. Remote evaporator 102 of the type in which refrigerant flow is exterior of the evaporator's tube bundle and is, in the preferred embodiment, an evaporator of the falling film type. Evaporator 102 is located interior of building 16 and the water flowing through its tubes, instead of being piped to the exterior of the building and to an evaporator co-located with the remainder of the air-cooled chiller system, is piped to evaporator 102 through piping 14 interior of building 16. Similarly, return water piping 18 resides within the building. Because evaporator 102 and the water piping associated with it is interior of building 16, it is not prone to freezing.

As opposed to water being piped outdoors to the chiller's evaporator from the interior of a building, refrigerant is piped indoors to remote evaporator 102 from condenser 22 through refrigerant supply piping 104. Supply piping 104 delivers refrigerant to and through expansion device 26 and into liquid-vapor separator 106 which is associated and co-located with evaporator 102.

Liquid-vapor separator 106 is employed with evaporator 102 because system refrigerant, after flowing through expansion device 26, will be a two-phase mixture that consists primarily of liquid refrigerant but has some refrigerant gas and lubricant entrained within it. Separator 106 separates the gaseous portion of the two-phase refrigerant mixture from the liquid portion thereof. Such separation facilitates the distribution of liquid refrigerant within evaporator shell 108. The gaseous portion of the refrigerant is routed out of the separator through piping 110 into the upper portion of the interior of the evaporator shell. That location is likewise the location to which refrigerant vaporized within the evaporator will flow enroute out of the evaporator.

The liquid portion of the refrigerant, together with any lubricant it contains, is delivered from liquid-vapor separator 106 through piping 112 into refrigerant distributor 114 which is located above tube bundle 116 within evaporator shell 108. Refrigerant distributor 114 distributes liquid refrigerant in low-energy, droplet form, together with any lubricant contained therein generally across the top of the length and width of tube bundle 116.

The liquid refrigerant and lubricant trickles downwardly through tube bundle 116 with the majority of the liquid refrigerant vaporizing in the process as it contacts the individual tubes 118 of the tube bundle through which a relatively warmer medium flows. As a result of refrigerant vaporization, liquid pool 120, located at the bottom of evaporator shell 108, will be relatively lubricant-rich. The refrigerant that vaporizes within evaporator 102 and/or which is delivered into the interior of the shell 108 thereof from liquid-vapor separator 106 is drawn out of the upper portion of shell 108 for delivery to compressor 20 through compressor suction piping 122.

Because the lubricant-rich mixture that constitutes pool 120 must be returned to compressor 20 or the quantity thereof will continually increase while the compressor's lubricant supply diminishes, methodology and/or an apparatus for accomplishing lubricant return to the compressor from evaporator 102 must be provided for. The oil-return methodology/apparatus of the present invention contemplates the use of an appropriately sized oil return line 122, which communicates between lubricant-rich pool 120 and compressor suction pipe 124, together with a suction pipe 124 that is sized and routed in a unique fashion to facilitate lubricant return.

In that regard, from its point of connection to the upper portion of the evaporator shell, where it draws vaporized refrigerant gas out of the shell's interior, suction pipe 124 is routed so as to travel below the level of lubricant-rich pool 120 within evaporator shell 108 prior to connecting to the system compressor. Oil return line 122, which opens into pool 120 generally in the lower portion thereof, connects into suction pipe 24 at a location where the suction pipe is disposed physically below the surface of pool 120.

Because lubricant line 122 connects into suction pipe 124 at a level below lubricant-rich pool 120, flow of the lubricant-rich mixture through line 122 occurs as a result of gravity and the head associated with the relatively elevated position of lubricant-rich pool 120. As the lubricant-rich mixture flows into suction pipe 124, it becomes entrained within the suction gas being drawn therethrough by and to compressor 20. Mixture flow from the evaporator is without the need for or use of another or different force by which to motivate such flow. As has been noted and as will be appreciated by those skilled in the art, however, the flow of lubricant out of the evaporator can be further assisted by appropriately sizing the suction line to purposefully create a pressure differential between the interior of the suction pipe and the interior of the evaporator. The result of such pressure differential will be to further encourage the flow of oil from the evaporator into the suction line location.

Overall, by running compressor suction pipe 124 from the location at which it connects into the upper portion of the evaporator shell to a location physically below the surface of the lubricant-rich liquid pool located in the bottom of the evaporator shell, by the connection of that portion of the suction piping to the lubricant-rich pool via an oil return line and by sizing the suction pipe to facilitate the lubricant return process, relatively very inexpensive, efficient and reliable lubricant return is achieved in a manner which need not be proactively controlled and which does not rely, for purposes of motivating the flow of the lubricant-rich liquid out of the evaporator shell, on any force other than those induced by gravity and head and/or, if necessary or appropriate in a particular installation, by sizing the suction line to create a differential pressure which encourages flow to the suction pipe location.

While the oil return process of the present invention does not rely on any form of proactive control or external motivating force to cause lubricant movement when the chiller is in operation, it is to be noted that a solenoid 126 and in-line filter 128 may be disposed in lubricant line 122. The purpose of filter 126 is self-evident while the purpose of solenoid 124 will be to prevent, by its closure, the content of pool 120 from draining into suction line 122 when the chiller shuts down. It is to be noted, however, that by appropriately sizing suction pipe 124 so that flow through lubricant line 122 will not occur unless a predetermined differential pressure is developed, as a result of chiller operation, between the evaporator and the location in suction line 124 to which lubricant is delivered, solenoid 124 can be dispensed with.

While the present invention has been described in terms of a preferred embodiment, it is to be appreciated that modifications thereto which fall within its scope will be apparent to those skilled in the art. In particular, while the preferred embodiment has been developed for and with an air-cooled water chiller employing a remote falling film evaporator in mind, the lubricant return arrangement of the present invention is conceptually applicable in most any chiller system and whether or not the evaporator is remote. Therefore, the present invention is to be limited and construed broadly within the context of the following claims.

What is claimed is:

1. A refrigeration system comprising:

a compressor;

a condenser, said condenser receiving refrigerant in which lubricant is entrained from said compressor;

an expansion device, said expansion device receiving refrigerant in which lubricant is entrained from said condenser;

an evaporator, said evaporator receiving liquid refrigerant and lubricant from said expansion device, a portion of the liquid refrigerant and the lubricant received into said evaporator making its way to and pooling in the bottom of said evaporator as a lubricant-rich mixture;

suction piping, said suction piping defining a flow path for refrigerant gas between said evaporator and said compressor, said suction piping connecting into said evaporator at a location above said lubricant-rich pool and being routed below the level of the surface of said pool prior to connecting to said compressor; and a lubricant line, said lubricant line communicating between said lubricant-rich pool and said suction line, said lubricant line connecting to said suction line at a location below the level of the surface of said pool, said lubricant-rich mixture flowing through said lubricant line and into said suction piping as a result of gravity and the head that results from the elevation difference between said pool and the location at which said lubricant line connects into said suction piping.

2. The refrigeration system according to claim 1 wherein said evaporator has a shell and a tube bundle, said tube bundle being disposed inside said shell, the refrigerant and lubricant received by said evaporator flowing exterior of the tubes in said tube bundle.

3. The refrigeration system according to claim 2 wherein said suction piping connects into said evaporator shell at a location in the upper portion of said shell and is routed therefrom to a location below the lowermost point of said evaporator shell prior to connecting to said compressor.

4. The refrigeration system according to claim 3 wherein said evaporator is a falling film evaporator.

5. The refrigeration system according to claim 4 wherein said evaporator is located remote from the compressor and said condenser of said refrigeration system.

6. The refrigeration system according to claim 5 wherein said condenser and said compressor are located outdoors and said condenser is an air-cooled condenser.

7. The refrigeration system according to claim 6 further comprising a liquid-vapor separator, said liquid-vapor separator being disposed in the flow path through which refrigerant and lubricant flows from said expansion device to said evaporator.

8. The refrigeration system according to claim 7 further comprising a refrigerant distributor, said refrigerant distributor being disposed above said tube bundle, said suction piping connecting into said shell of said evaporator generally above said refrigerant distributor, liquid refrigerant and lubricant flowing from said liquid-vapor separator into said refrigerant distributor and refrigerant in vapor form flowing from said liquid-vapor separator into said shell of said evaporator at a location generally above said distributor.

9. The refrigeration system according to claim 8 wherein said lubricant line connects into the shell of said evaporator at a location generally at the bottom of said lubricant-rich pool.

10. The refrigeration system according to claim 9 further comprising a device for preventing flow through said lubricant line when said chiller is shut down.

11. A method for returning compressor lubricant from the evaporator to the compressor of a refrigeration chiller comprising the steps of:

collecting lubricant that makes its way out of said compressor in a pool at the bottom of said evaporator;

connecting said evaporator to said compressor with a suction line through which gaseous refrigerant is drawn out of the interior of said evaporator and is delivered to said compressor when said chiller is in operation, said suction line communicating with the interior of said evaporator at a location above said pool;

routing said suction line such that a portion thereof runs physically below the surface level of said pool located in the bottom of said evaporator;

defining a flow path between said pool and said compressor suction line, said flow path communicating with the interior of said suction line at a location which is physically below the surface level of said pool;

flowing lubricant from said pool into said suction line through said flow path under the impetus of both gravity and the head which results from the difference in elevation between said pool and the location at which said flow path connects into said suction line;

drawing refrigerant gas out of said evaporator, through said suction line, for delivery to said compressor; and delivering lubricant to said compressor entrained in the suction gas drawn through said suction line in said drawing step.

12. The method for returning compressor lubricant according to claim 11 wherein said evaporator has a tube bundle and comprising the further step of flowing refrigerant within said evaporator, in which lubricant is entrained, exterior of the tubes of said tube bundle.

13. The method for returning compressor lubricant according to claim 12 comprising the further step of locating said evaporator remote from the compressor and condenser of said chiller.

14. The method for returning compressor lubricant according to claim 13 wherein said locating step includes the steps of locating said compressor and said condenser outdoors and locating said evaporator indoors.

15. The method for returning compressor lubricant according to claim 12 comprising the further step of distributing liquid refrigerant in which lubricant is entrained across the top of said tube bundle prior to said refrigerant flowing step.

16. The method for returning compressor lubricant according to claim 15 comprising the further steps of flowing refrigerant in which lubricant is entrained/through an expansion device; separating refrigerant vapor from liquid refrigerant and lubricant downstream of said expansion device and prior to said distributing step; and, flowing refrigerant vapor separated in said separating step into the interior of the shell of said evaporator.

17. The method for returning compressor lubricant according to claim 16 comprising the further step of preventing said step of flowing lubricant from said pool into said suction line through said flow path when said chiller shuts down.

* * * * *